United States Patent [19]

Gajjar

[11] 4,020,656

[45] May 3, 1977

[54] METHOD OF WARP KNITTING

[75] Inventor: Bharat Jaybhadra Gajjar, Wilmington, Del.

[73] Assignee: E. I. Du Pont de Nemours and Company, Wilmington, Del.

[22] Filed: July 29, 1976

[21] Appl. No.: 709,659

Related U.S. Application Data

[63] Continuation-in-part of Ser. No. 620,832, Oct. 8, 1975, abandoned.

[52] U.S. Cl. ..... 66/213; 66/125 R

[51] Int. Cl.[2] ..... D04B 23/00

[58] Field of Search ..... 66/125, 203, 213, 209, 66/195

[56] References Cited

UNITED STATES PATENTS

| | | | |
|---|---|---|---|
| 1,234,927 | 7/1917 | Myers et al. | 66/125 |
| 2,608,079 | 8/1952 | Slater | 66/195 |
| 3,861,175 | 1/1975 | Farmer | 66/213 |

*Primary Examiner*—Ronald Feldbaum

[57] ABSTRACT

A warp-knitted fabric with surface interest patterning is formed from two full sets of warp threads being fed to each position of two separate guide bars of a warp knitting machine then to each needle of the warp knitting machine and from a partial set of threads being fed to spaced positions of at least one of the two guide bars and then to spaced needles for knitting together with one of the full sets of threads. The partial beam set of threads is fed at a different rate from the rate of the associated full set of warp threads being fed to the same guide bar.

13 Claims, 15 Drawing Figures

STITCH
FRONT BAR
BACK BAR

JERSEY
2-3, 1-0
1-0, 1-2
41
42

MODIFIED JERSEY
1-0, 2-3
2-3, 1-0

REVERSE JERSEY
1-0, 1-2
2-3, 1-0

LONG-FLOAT JERSEY
3-4, 1-0
1-0, 1-2

STABILIZED
1-0, 0-1
3-4, 1-0

TAFFETA
1-0, 0-1
1-0, 4-5

SHORT-FLOAT DELAWARE
1-2, 1-0
1-0, 0-1

DELAWARE
2-3, 1-0
1-0, 0-1

LONG-FLOAT DELAWARE
3-4, 1-0
1-0, 0-1

SATIN-FLOAT DELAWARE
4-5, 1-0
1-0, 0-1
0 1 2 3 4 5
0 1 2 3 4 5

METHOD OF WARP KNITTING

CROSS REFERENCE TO RELATED APPLICATION

This is a continuation-in-part of my copending U.S. application Ser. No. 620,832, filed Oct. 8, 1975, now abandoned.

BACKGROUND OF THE INVENTION

This invention relates to warp knitted fabrics and more particularly to the method of knitting the fabrics to produce surface interest patterning.

Basic warp-knitting, to which this invention applies, comprises knitting on tricot or Raschel machines using basic plain stitches, for example, Jersey or Delaware stitches, or their well-known variations. These knitted fabrics are characterized by unvarying stitch formation; i.e., all stitches in a given course are identically formed, and each course is formed exactly the same as alternating courses before and after it in the fabric. The front-bar and back-bar stitch patterns are different, but each starts in one course, generally ends in the next, and repeats for succeeding pairs of courses. Basic warp-knitting permits very high production rates, but the fabrics have only plain surface aesthetics free of any surface-interest patterning. The prior art includes many techniques for forming surface patterns in warp-knitted fabrics, but all of these known techniques involve complicated variation in stitch patterns, the laying in of extra ends in pattern-forming arrays, or like complications which diminish productivity and add to the cost of fabrics produced.

SUMMARY OF THE INVENTION

This invention provides a method for preparing fabrics having spaced warpwise visible line patterns using basic warp-knitting stitch constructions with their inherently high productivity rates. It also provides a warp-knitted fabric with spaced warpwise visible line patterns. These advantages result from an improvement on a method for producing warp knitted fabrics on a single needle bed warp knitting machine having two full sets of warp threads, that includes the steps of feeding one of the two full sets of warp threads to each position of one of two operating guide bars then to each needle of the warp knitting machine and feeding the other of the two sets to each position of the other operating guide bar and to each needle of the warp knitting machine to form a knitted fabric. The improvement comprises: feeding a partial beam set of threads to spaced positions of at least one of the guide bars and then to spaced needles for knitting together with one of the full beam sets of threads. The partial beam set of threads is preferably underfed with respect to the full beam set of threads being fed to the same guide bar. However, high retraction, high deniers of combined double ends, or high shrinkage during finishing of the threads from the partial beam can create adequate stitch distortions with limited overfeeding up to R of about 1.3.

DETAILED DESCRIPTION OF THE PREFERRED EMBODIMENT

"Basic warp-knitting", as intended herein, is best defined in terms of stitch patterns, as shown in FIGS. 1A to 1J. While many other patterns constituting basic warp-knitting are theoretically possible, the ones shown represent most of those used commercially. For each, a single needle-bar is employed, being fed from front-bar and back-bar warps of knitting yarns or threads. Knitting needle positions for each of two successive courses are represented in the diagrams by horizontal lines of dots, the top line representing the course formed immediately after the course represented by the bottom line. Only one front-bar and one back-bar yarn are shown in each instance, it being understood that one end of each is knitted on each knitting needle for every course. More particularly, referring to FIG. 1A, the stitch construction of the fabric is notationally set out and shows that the threads of the front bar, one of which is indicated at 41, have back and forth movement to non-adjacent needle in successive courses as indicated by the numbers 2-3, 1-0 and that the threads of the back bar, one of which is indicated as 42, have similar movements as indicated by the numbers 1-0, 1-2. The Delaware stitches are particularly characterized by chain-stitched back-bar threads as indicated by the numbers 1-0, 0-1, (FIGS. 1G-1J). These may be open stitches (as shown) or closed loops.

The fabric is preferably made according to the invention on a tricot or similar warp knitting machine employing a single needle bar and at least two yarn guide bars respectively known as the back guide bar and the front guide bar. The needle bar is provided with knitting needles which may vary in number according to the gauge of the machine, and each guide bar has a number of yarn guides corresponding to the number of needles of the needle bar. The guide bars are able to be shogged under pattern control a distance of one or more needles in opposite directions lengthwise of the needle bar, and both guide bars are also swingable transversely of the needle bar to permit their yarn guides to pass between the needles, the combined shogging and swinging movements permitting the yarns to be fed to the needles and to be knit thereby.

Figure 2:
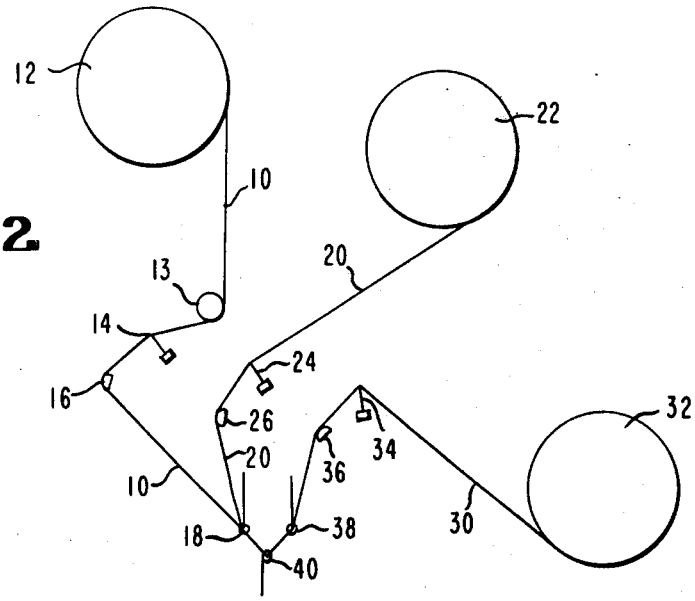
FIG. 2 is a schematic end elevation of the apparatus elements for basic warp knitting.
Figure 3:
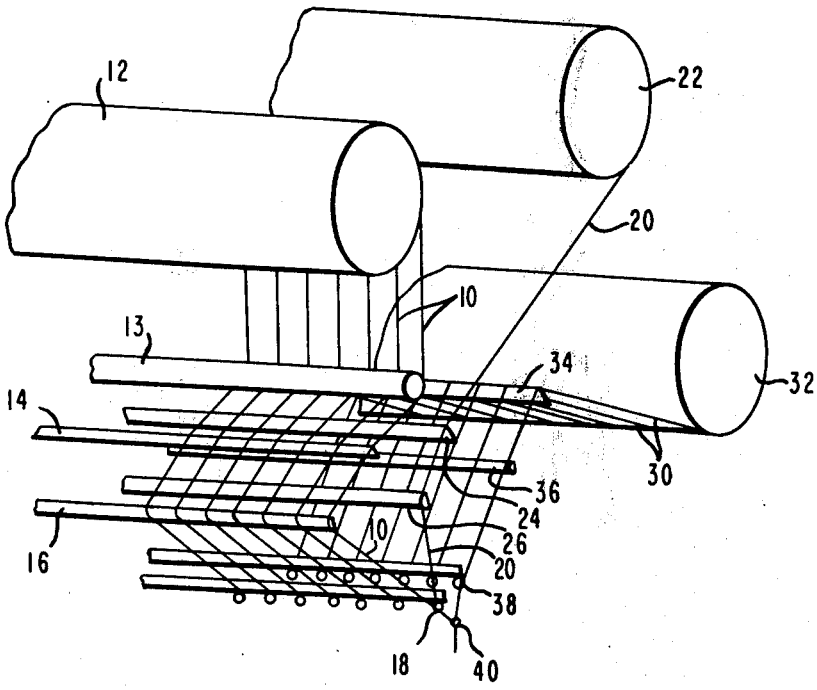
FIG. 3 is a partial front isometric view of FIG. 1 without the needle bed.

A schematic arrangement for such warp-knitting machine is shown in FIGS. 2 and 3. The top (or front) bar warp is fed from a warp-set of yarns or threads 10 on beam 12. The threads of 10 pass in the usual well-known manner around a direction changing bar 13 through a fixed reed 14, which serves to keep the threads separated in open dents (not shown), and over tension-bar 16, which has a smooth yarn-contacting surface extending across the whole width of the warp. The tension bar is flexibly mounted to permit vibration and thus to tend to equalize tensions on the threads. From tension-bar 16, each end is then threaded through its guide in front guide-bar 18 and on to needle-bar 40. Similarly, the bottom (or back) bar warp is led from a warp-set of yarns or threads 30 on beam 32 via fixed reed 34, tension-bar 36, and back guide-bar 38 to needle-bed 40. Additionally, middle warp set of threads 20 is fed from middle beam 22 via fixed reed 24, tension bar 26 and front guide bar 18 to the needle bed 40. The middle beam 22 has only a partial set of threads 20 each of which pass with a corresponding front-bar thread 10 through spaced guides in the front guide-bar 18 to associated spaced needles on needle bed 40. Knitting results from two kinds of motion, as is well known. The two guide-bars 18, 38 swing back and forth together along an arc in the plane of FIG. 2, and each is separately shogged into and out of the plane of FIG. 2 according to a preselected pattern.

The provision of warpwise line patterns in basic warp-knitted fabrics according to this invention results from warp knitting using basic stitch constructions as shown in FIG. 1A-1J wherein each guide bar (18, 38) is fed from a full warp set of threads (10, 30) and one bar (preferably the front bar 18) is also fed from a third partial warp set of threads 20 and these ends are then fed to spaced needles in the needle bed 40 where they are knitted together as one in these spaced positions. While only the first position on guide bar 18 in FIG. 3 is shown to accommodate both threads 10 and 20, the spacing selected between the added threads 20 may vary over a wide range depending on the stripe-like pattern desired. It is further necessary that the two combined threads, e.g., 10, 20, provide different lengths per stitch in the knitted fabric. This is best accomplished by feeding the two warp sets of threads 10, 20 at different rates which provides differences in tension on the double threads in warp sets 10, 20. One method of setting forth these differences in tension is by the ratio R of the runner length of the partial beam set of threads 20 to the runner length of the full beam set of threads 10. Runner length is the number of inches of each yarn used in knitting one rack (480 consecutive courses) of stitches. The ratio R may range from about 0.50 to about 1.30, but it is preferably less than about 1.00. If the threads 10 and 20 have different retraction and/or shrinkage properties, differences in tension arising from these sources also contribute to the patterning effects either before or during fabric finishing.

When the method of this invention is used with Delaware stitch constructions (FIGS. 1G to 1I,), which have a tendency toward instability characterized by random wale groupings in scattered areas of the fabric, it has been found that stable and uniform wale groupings occur throughout the fabric along the entire length of the fabric. The number of wales per group corresponds to the number of needles per float in the top-bar stitch. Thus, for instance, when the middle-beam ends are fed through every seventh yarn guide in a guide-bar for Delaware stitch (FIG. 1H) warp knitting, stitch distortions are caused in each set of three wales indicating the added end to create a group of three closely spaced wales bounded by much wider interwale spacings. This, in turn, has the unexpected and advantageous result that the remaining four wales in each seven wale repeat of the pattern wale-shift to form two groups of two closely spaced wales bounded by much wider interwale spacings. A construction identical to the above in every way except that the extra end is fed to every sixth needle produces the unique 3-wale grouping including the added end, but the three remaining wales of the repeat pattern are normally spaced. In corresponding fashion, the Long-Float Delaware stitch (FIG. 1I) yields 4-wale groupings including the added end, the remaining wales in the repeat shifting into 3-wale groupings if their number is evenly divisible by 3. Likewise, the Satin-Float Delaware stitch (FIG. 1J) yields five and four wale groupings, etc. The threads from the added partial warp-set are preferably spaced apart by a needle-spacing no less than the number of needles per float in the top-bar knitting pattern, but closer spacing creates new patterns resulting from overlapping of the above-described effects. A variety of stripe-like patterns of wale groupings can be obtained by selecting different spacing between the added ends, including variations in spacing across the fabric width.

While the illustrated embodiment shows the preferred arrangement for feeding the partial beam set of threads to the front guide bar 18 of the knitting machine, alternatively the partial beam set of threads could be fed to the back guide 38 or to both the front and back guide bars creating similar spaced visible line patterns in the fabric.

While it is preferred that the process of this invention be carried out on knitting machines having two guide bars and a single needle bar, it is apparent to those skilled in the art that knitting with multiple guide bars and/or two needle bars also can produce similar patterning using the invention. It is required only that ends from an independent partial warp supply be doubled at the guide bar with spaced ends of a fully threaded warp supply.

Any yarns useful for known warp-knit processing may be used in making fabric according to this invention. Included are synthetic thermoplastic yarns in either filament or spun-staple form, yarns spun from natural fibers, and yarns from mixtures of synthetic and natural fibers.

Conventional finishing procedures are suitable for fabrics made according to this invention. In the examples, except for random selection of color of the disperse dyes used, all greige fabrics are finished identically. After heat setting for thirty seconds at 380° F (193° C) on a pin tenter frame at 10% overfeed and 5% underwidth, they are scoured, washed, dyed, and again washed in a beck. Scouring is for thirty minutes at 180° F (82° C) using an aqueous dispersion of surfactant and emulsified hydrocarbon scouring solvent. Initial washing is for 20 minutes at 160° F (71° C) in water containing detergent. After 5 minutes at 120° F (49° C) in water containing wetting agent, dispersing agent, and a dye assist, pH is adjusted to 6 with acetic acid, the selected dye is added, and temperature is raised to 160° F (71° C) before adding butyl benzoate dye carrier. Dyeing continues at the boil for 90 minutes. Final washing identical to initial washing ends treatment in the back. Finishing is completed by heat setting at 350° F (177° C) on a pin tenter frame at wet width and 5% overfeed.

The following terms are used in the Examples and are defined below:

Rack is defined as 480 consecutive courses (knitted rows) of stitches.

Runner length is the length of each yarn used in knitting one rack.

Quality denotes the length of one rack of knitted fabric.

Gauge specifies the number of knitting needles per inch (per 2.54 cm) in the needle bar.

Count (W/C) specifies the number of wales (W) and courses (C) per unit of length measured perpendicular to the fabric direction of each.

Greige (also, occasionally, "gray") describes untreated fabric just as it comes from the knitting machine. Before it is sold, the greige fabric is ordinarily treated by washing, scouring, dyeing, heat-setting, or the like, after which it is referred to as "finished" fabric.

Bulk is computed from weight per unit area, W, and from thickness, $t$, according to Bulk = (t/W)x(units conversion factor)

When W is given in oz/yd$^2$ and $t$ in inches, Bulk in cc/gm is computed from

Bulk = (t/W)x748.5.

In the examples, Yarns A and B are both of 30 denier (33.3 dtex) and are prepared substantially as described in Example I of Knospe, U.S. Pat. No. 3,416,302. Each filament has a trilobal cross-section as taught by Holland in U.S. Pat. No. 2,939,201. Yarn A has 10 filaments, and Yarn B has 18 filaments. In each yarn, half of the filaments are composed substantially of PACM-12 homopolymer and the other half of PACM-12/PACM-I (90/10 by weight) copolymer. PACM denotes the polymer unit corresponding to bis-(4-aminocyclohexyl) methane; 12 denotes the polymer unit corresponding to dodecanedioic acid; and I denotes the polymer unit corresponding to isophthalic acid. The PACM employed contains 70% by weight of its trans-trans isomer.

Yarn C is provided on partial beams only and is a commercially available crimped 30 denier (33.3 dtex) round cross-section monofilament of poly-ε-caproamide. It is crimped as described by Rice in U.S. Pat. No. 3,256,134.

In the examples, a commercial 32-gauge two-bar single needle bed warp knitting machine is employed. The top beam and the back beam are provided with the same kind of knitting yarn, each fully threading the respective guide bars. A third partial beam is employed, feeding the same or different knitting yarns as shown in Tables 1, 3 and 5. Each end from the middle (partial) beam is doubled with an end from the top beam, the two being led through the same guide in the front guide bar and knitted together as a single end. Doubled ends in the front guide bar are at spaced needle positions. In most of the examples, only every seventh end is doubled, the pattern being repeated across the full fabric width. In those fabrics whose numbers are marked with the symbol (No.), the fabric has six zones across its width with each zone having a different spacing of doubled ends according to:

Zone 1 every fourth end doubled
Zone 2 every fifth end doubled
Zone 3 every sixth end doubled
Zone 4 every seventh end doubled
Zone 5 every eighth end doubled
Zone 6 every ninth end doubled The use of spaced doubled ends causes the creation of longitudinal patterning by uniform grouping of wales, the degree of patterning depending largely on the ratio (R) of middle bar to top bar runner lengths, i.e., differences in tension on the doubled ends. The lower this ratio, the greater the patterning effect. In addition, differences in retraction, shrinkage on finishing, and sizes of the doubled ends influence the degree of patterning. Tables of results in the examples list the fabrics prepared in descending order of the magnitudes of R.

Every fabric exemplified exhibits longitudinal striped patterning on its float side, these patterns being rather diffuse and generally devoid of clearcut interwale spacings. In the examples, patterning as viewed from the loop sides of the fabrics is discussed and compared.

EXAMPLE I

This example compares fabrics made using the Delaware stitch which has a 2-3,1-0 repeated front bar stitch and a back bar chain stitch (mostly 1-0,0-1 open chain, but also 0-1,1-0 open chain and 0-1,0-1 closed chain as indicated in Tables 1 and 2). Patterning effects appear to be independent of which chain stitch is used in the back bar. Data relevant to knitting of the fabrics are given in Table 1; fabric characterizations are in Table 2.

Little or no patterning is evident on the loop face of Fabric IA except for enlargement and distortion of every seventh wale. Fabric IB shows little or no shifting of wale spacings but nevertheless has a muted longitudinally striped effect in which 3-wale groupings with relatively opaque interwale spacings are separated by four normally knit and spaced wales each bounded by relatively open interwale spacings. In these and all the remaining fabrics of this example, the 3-wale groupings correspond to the 3-needle floats of each doubled front-bar end.

Fabric IC introduces a new patterning effect in that, in addition to the readily distinguishable 3-wale groupings, the four intervening wales undergo wale shifting to form two 2-wale groupings of close wales, each 2-wale grouping separated from the adjacent 2-wale and 3-wale groupings by extra-wide, more open, interwale spacings.

Fabric ID, using the same yarns as Fabric IA, is very similar in appearance to Fabric IA. The lack of clear patterning for this fabric is unexplained.

Figure 4:
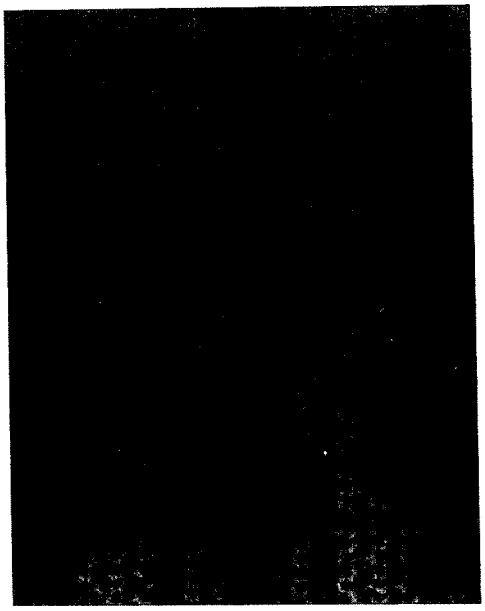
FIGS. 4, 5, and 6 are photographs of fabric made as described in Examples I, II, and III, respectively.

Fabrics IE through IM (comparing only Zone 4 of Fabric IF) have the same 3×2×2 wale-shifted pattern as described for Fabric IC. As R decreases, the wales in each grouping move closer together, the interwale spacings between groupings become wider and relatively more open, and the patterns become sharper and more striking. FIG. 4 is an enlarged photograph of Fabric IF (Zone 4) typifying the patterning described.

Fabric IF illustrates patterning changes accompanying different frequencies of doubled ends. Zone 1 has 3-wale groupings alternating with single wales set off by widened interwale spacings. In Zone 2, the two wales between the 3-wale groupings are shifted close together with extra-wide interwale spacings between 3-and 2-wale groupings. Zone 3 has three normally spaced wales between the 3-wale groupings. Zone 4 (discussed above) has four wales between 3-wale groupings which are wale-shifted to form two 2-wale groupings. Zone 5 has five normally spaced wales between 3-wale groupings. Zone 6 has three wale-shifted 2-wale groupings between 3-wale groupings. It is apparent that, when an even number of wales devoid of doubled ends are left between the 3-wale groupings including doubled ends, the intervening wales shift to provide regular 2-wale groupings which are stable and uniform throughout the fabric length.

TABLE 1

KNITTING PARAMETERS
DELAWARE STITCH (2-3,1-0/1-0,0-1)

| Fabric No. | Yarns Top Beam | Yarns Middle Beam | Yarns Back Beam | Runner Lengths(in.) Top | Runner Lengths(in.) Middle | Runner Lengths(in.) Back | Runner Lengths(m.) Top | Runner Lengths(m.) Middle | Runner Lengths(m.) Back | Quality (in.) | Quality (cm.) | R middle/top |
|---|---|---|---|---|---|---|---|---|---|---|---|---|
| I-A | B | A | B | 51.5 | 84 | 33 | 1.308 | 2.134 | .838 | 6 | 15.2 | 1.63 |
| I-B | A | A | A | 56 | 61 | 30.5 | 1.422 | 1.549 | .775 | 6 | 15.2 | 1.09 |
| I-C | A | A | A | 55 | 55 | 30.5 | 1.397 | 1.397 | .775 | 6 | 15.2 | 1.00 |
| I-D | B | A | B | 51 | 49 | 34 | 1.295 | 1.245 | .864 | 6 | 15.2 | 0.96 |
| I-E | A | A | A | 56 | 51 | 30.5 | 1.422 | 1.295 | .775 | 6 | 15.2 | 0.91 |
| I-F** | A | A | A | 56.75 | 47 | 31.25 | 1.378 | 1.194 | .794 | 6 | 15.2 | 0.83 |
| No. | | | | | | | | | | | | |
| I-G* | B | C | B | 55.5 | 42.5 | 30 | 1.410 | 1.080 | .762 | 6 | 15.2 | 0.77 |
| I-H | A | A | A | 56 | 43 | 30.5 | 1.422 | 1.092 | .775 | 6 | 15.2 | 0.77 |
| I-I | B | A | B | 55.5 | 42.5 | 30 | 1.410 | 1.080 | .762 | 6 | 15.2 | 0.77 |
| I-J* | B | C | B | 61 | 42.5 | 30 | 1.549 | 1.080 | .762 | 6 | 15.2 | 0.70 |
| I-K | B | A | B | 56 | 39 | 34 | 1.422 | .991 | .864 | 6 | 15.2 | 0.70 |
| I-L | B | A | B | 61 | 42.5 | 30 | 1.549 | 1.080 | .762 | 6 | 15.2 | 0.70 |
| I-M | A | A | A | 61 | 43 | 30.5 | 1.549 | 1.092 | .775 | 6 | 15.2 | 0.70 |

*Backbar stitch 0-1,1-0 open chain
**Backbar stitch 0-1,0-1 closed chain

TABLE 2

FABRIC CHARACTERIZATIONS - DELAWARE STITCH

| Fabric No. | Finished Fabric Weight oz./yd. | Finished Fabric Weight gm./100 cm.² | Finished Fabric Width in. | Finished Fabric Width m. | Finished Fabric Count (W×C) in.⁻¹ | Finished Fabric Count (W×C) cm.⁻¹ | Finished Fabric Bulk (cc/gm) | Greige Fabric Weight oz/yd | Greige Fabric Weight gm/100 cm² | Greige Fabric Bulk cc/gm. |
|---|---|---|---|---|---|---|---|---|---|---|
| I-A | 2.70 | .916 | 70.75 | 1.797 | 38×90 | 15.0×35.4 | 6.38 | 2.30 | .781 | 4.90 |
| I-B | 2.4 | .814 | 78.5 | 1.994 | 34×90 | 13.4×35.4 | 5.06 | 2.1 | .713 | 6.09 |
| I-C | 2.3 | .781 | 78.25 | 1.988 | 34×96 | 13.4×37.8 | 4.42 | 2.1 | .713 | 5.03 |
| I-D | 2.45 | .831 | 73.5 | 1.867 | 36×95 | 14.2×37.4 | 4.07 | 2.20 | .747 | 4.10 |
| I-E | 2.4 | .814 | 78.25 | 1.988 | 34×90 | 13.4×35.4 | 4.78 | 2.1 | .713 | 5.51 |
| I-F | 2.4 | .814 | 78 | 1.981 | 34×89 | 13.4×35.0 | 4.29 | 2.2 | .747 | 6.53 |
| No. | | | | | | | | | | |
| I-G | 2.28 | .774 | 41.25 | 1.048 | 32×98 | 12.6×38.6 | 5.29 | 2.22 | .753 | 6.54 |
| I-H | 2.5 | .848 | 78.25 | 1.988 | 34×99 | 13.4×39.0 | 5.04 | 2.1 | .713 | 6.12 |
| I-I | 2.68 | .909 | 72.5 | 1.842 | 37×94 | 14.6×37.0 | 5.39 | 2.10 | .713 | 5.58 |
| I-J | 2.53 | .859 | 42.33 | 1.075 | 33×96 | 13.0×37.8 | 5.77 | 2.24 | .760 | 6.85 |
| I-K | 2.54 | .862 | 70.83 | 1.799 | 37×86 | 14.6×33.9 | 5.01 | 2.20 | .747 | 4.83 |
| I-L | 2.88 | .977 | 72.5 | 1.842 | 38×100 | 15.0×39.4 | 6.03 | 2.20 | .747 | 5.43 |
| I-M | 2.4 | .814 | 78.5 | 1.994 | 34×86 | 13.4×33.9 | 6.35 | 2.1 | .713 | 7.00 |

EXAMPLE II

Figure 5:
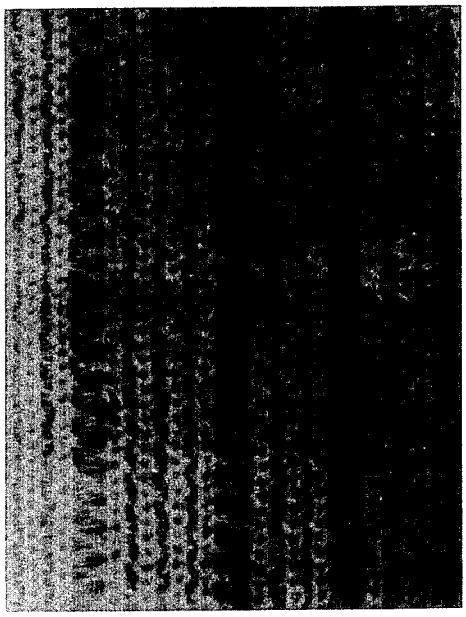

Tables 3 and 4 characterize fabrics prepared as described in Example I except for use of the Long-Float Delaware knitting stitch. This stitch uses a 3-4,1-0 knitting pattern for the front bar and a chain stitch for the back bar. Because each doubled end becomes knitted into four wales, 4-wale groupings analagous to the 3-wale groupings of Example I are formed when R is sufficiently low. Zone 4 of Fabric II-A and the whole widths of the remaining fabrics of this example have doubled ends at every seventh position of the front guide bar. FIG. 5 is typical of the wale-shifted patterned effects of these fabrics (Zone 4 of Fabric II-A). The tightness with which wales are shifted together within the groupings, and the width of interwale spacings between groupings, increase with decreasing R. All of these fabrics exhibit tight 4-wale groupings including the doubled ends alternating with tight 3-wale groupings devoid of doubled ends.

Fabric II-A illustrates the effect of varying the frequency of doubled ends. Zone 1 has repetitive 4-wale groupings across its width with extra-wide interwale spacings between the groupings. Zone 2 has 4-wale groupings alternating with spaced single wales. In Zone 3, 4-wale groupings, alternate with tight 2-wale groupings. Zone 4, as above described, has 4×3wale groupings. Zone 5, unexpectedly, has 4×1×2×1 groupings, and Zone 6 has 4×2×1×2 groupings. While not included in the examples, when every tenth end is crossed the groupings in repetitive sequence are 4×3×3 indicating the natural tendency for Long-Float Delaware stitch to form only 3-wale groupings between 4-wale groupings when the number of wales available is divisible by three. It is of further interest that the 4-wale groupings of Zones 2 and 5 are slightly separated into two 2-wale groupings.

TABLE 3

KNITTING PARAMETERS
LONG-FLOAT DELAWARE STITCH (3-4,1-0/1-0,0-1)

| Fabric No. | Yarns Top Beam | Yarns Middle Beam | Yarns Back Beam | Runner Lengths(in.) Top | Runner Lengths(in.) Middle | Runner Lengths(in.) Back | Runner Lengths (m) Top | Runner Lengths (m) Middle | Runner Lengths (m) Back | Quality (in) | Quality (cm.) | R middle/top |
|---|---|---|---|---|---|---|---|---|---|---|---|---|
| II-A | A | A | A | 75 | 61 | 32 | 1.905 | 1.549 | .813 | 6 | 15.2 | 0.81 |
| No. | | | | | | | | | | | | |
| II-B | A | A | A | 74.5 | 56 | 34 | 1.892 | 1.422 | .864 | 6 | 15.2 | 0.75 |
| II-C | A | A | A | 77 | 56 | 34 | 1.956 | 1.422 | .864 | 6 | 15.2 | 0.73 |
| II-D | A | A | A | 76 | 54 | 34 | 1.930 | 1.372 | .864 | 6 | 15.2 | 0.71 |
| II-E | B | A | B | 84 | 52 | 31 | 2.134 | 1.321 | .787 | 6 | 15.2 | 0.62 |

TABLE 3-continued

KNITTING PARAMETERS
LONG-FLOAT DELAWARE STITCH (3-4,1-0/1-0,0-1)

| Fabric No. | Yarns Top Beam | Middle Beam | Back Beam | Runner Lengths(in.) Top | Middle | Back | Runner Lengths (m) Top | Middle | Back | Quality (in) | (cm.) | R middle/top |
|---|---|---|---|---|---|---|---|---|---|---|---|---|
| II-F* | B | C | B | 84 | 52 | 31 | 2.134 | 1.321 | .787 | 6 | 15.2 | 0.62 |

*Backbar stitch 0-1,1-0 open chain

TABLE 4

FABRIC CHARACTERIZATIONS - LONG-FLOAT DELAWARE STITCH

| Fabric No. | 64 Finished Fabric Weight oz/yd² | gm/100cm² | Width in. | m. | Count (W×C) in.⁻¹ | cm.⁻¹ | Bulk (cc/gm) | Greige Fabric Weight oz/yd² | gm/100cm² | Bulk cc/gm. |
|---|---|---|---|---|---|---|---|---|---|---|
| II-A | 2.95 | 1.001 | 78.5 | 1.994 | 34×88 | 13.4×34.6 | 5.41 | 2.5 | .848 | 6.48 |
| No. | | | | | | | | | | |
| II-B | 2.8 | .950 | 78.25 | 1.988 | 34×86 | 13.4×33.9 | 5.17 | 2.5 | .848 | 6.00 |
| II-C | 2.8 | .950 | 78.25 | 1.988 | 34×86 | 13.4×33.9 | 6.02 | 2.6 | .882 | 6.34 |
| II-D | 2.8 | .950 | 78.25 | 1.988 | 34×90 | 13.4×35.4 | 5.57 | 2.5 | .848 | 6.22 |
| II-E | 3.3 | 1.120 | 73.5 | 1.867 | 36×92 | 14.2×36.2 | 6.81 | 2.6 | .882 | 6.00 |
| II-F | 2.91 | .988 | 43.88 | 1.115 | 32×93 | 12.6×36.6 | 6.67 | 2.77 | .940 | 7.19 |

EXAMPLE III

Figure 6:
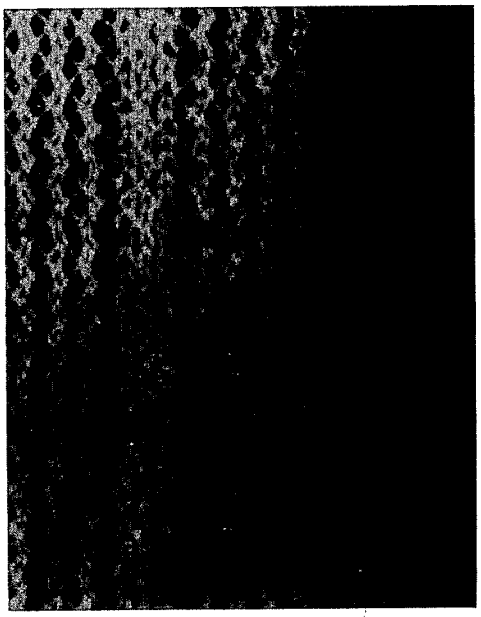

Tables 5 and 6 characterize fabrics prepared as described in Examples I and II except for the use of the Jersey knitting stitch. This stitch uses a 2-3,1-0 knitting pattern for the front bar and a 1-0,1-2 pattern for the back bar. Because each doubled end becomes knitted into three wales, 3-wale groupings analogous to the 3-wale groupings of Example I are formed when R is sufficiently low. Zone 4 of Fabric III-H and the whole widths of the remaining fabrics of this example have doubled ends at every seventh position of the front guide bar. FIG. 6 (Fabric III-I) shows the type of patterning obtainable using Jersey stitch. The tightness with which wales are shifted together in the 3-wale groupings and the extent of zig-zag distortion of remaining wales increase with decreasing R.

The loop faces of Fabrics III-A and III-B are barely distinguishable from Jersey knits made without any doubled ends. No clearcut 3-wale groupings occur. Regular 3-wale groupings are distinguishable in Fabric III-E, but without noticeable wale shifting. Fabric III-F is also very similar, its 3-wale groupings being more clearly distinguished.

Fabric III-D represents an intermediate type of patterning in which a single wale of each 3-wale grouping is set off from remaining wales by extra-wide interwale spacings and the six wales between nearest set-off wales are substantially normally knit and spaced.

Fabrics III-G through III-J all exhibit the same patterning, its intensity increasing with decreasing R. First, the stitches in each wale are distorted in zig-zag fashion walewise. Second, the wales in each 3-wale grouping shift closer together. Finally, the tighter the 3-wale groupings associate, the less do their stitches appear distorted. Simultaneously, the four evenly spaced wales between consecutive 3-wale groupings become more distorted. Preferred patterns result when R is less than or about 1.00.

Fabric III-H illustrates the effect of varying the frequency of doubled ends. No extra wale shifting between 3-wale groupings occurs, nor is any change in zig-zag distortion of the stitches observed due only to the changes in frequency. Instead, the number of evenly spaced wales between 3-wale groupings increases regularly from Zone 1 to Zone 6.

TABLE 5

KNITTING PARAMETERS
JERSEY STITCH (2-3,1-0/1-0,1-2)

| Fabric No. | Top Beam | Middle Beam | Back Beam | Runner Lengths (in.) Top | Middle | Back | Runner Lengths (m.) Top | Middle | Back | Quality (in.) | (cm.) | R middle/top |
|---|---|---|---|---|---|---|---|---|---|---|---|---|
| IIIA | B | C | B | 55 | 82 | 42.5 | 1.397 | 2.083 | 1.080 | 7 | 17.8 | 1.49 |
| III-B | B | A | B | 55 | 82 | 42.5 | 1.397 | 2.083 | 1.080 | 7 | 17.8 | 1.49 |
| III-C | A | A | A | 55 | 82 | 42.5 | 1.397 | 2.083 | 1.080 | 7 | 17.8 | 1.49 |
| III-D | B | A | B | 56 | 72.5 | 43 | 1.422 | 1.842 | 1.092 | 8.25 | 21.0 | 1.29 |
| III-E | A | A | A | 55 | 70 | 42.5 | 1.397 | 1.778 | 1.080 | 7 | 17.8 | 1.29 |
| III-F | A | A | A | 55 | 60 | 42.5 | 1.397 | 1.524 | 1.080 | 7 | 17.8 | 1.09 |
| III-G | A | A | A | 72.25 | 68 | 45.75 | 1.835 | 1.727 | 1.162 | 10 | 25.4 | 0.94 |
| III-H | A | A | A | 62.5 | 56 | 36.50 | 1.588 | 1.422 | .927 | 6 | 15.2 | 0.90 |
| No. | | | | | | | | | | | | |
| III-I | B | C | B | 72.25 | 45.75 | 37.25 | 1.835 | 1.162 | .946 | 7 | 17.8 | 0.63 |
| III-J | B | A | B | 72.25 | 45.75 | 37.25 | 1.835 | 1.162 | .946 | 10 | 25.4 | 0.63 |

TABLE 6

FABRIC CHARACTERIZATIONS - JERSEY STITCH

| Fabric No. | Finished Fabric Weight oz/yd² | gm/100cm² | Width in. | m. | Count(W × C) in.⁻¹ | cm.⁻¹ | Bulk cc/gm | Greige Fabric Weight oz/yd² | gm/100cm² | Bulk cc/gm. |
|---|---|---|---|---|---|---|---|---|---|---|
| III-A | 2.23 | .757 | 26.75 | .679 | 40 ×0 59 | 15.7 × 23.2 | 5.51 | 2.32 | .787 | 5.65 |
| III-B | 2.74 | .930 | 54.25 | 1.378 | 48 × 62 | 18.9 × 24.4 | 5.71 | 2.40 | .814 | 4.60 |

TABLE 6-continued

FABRIC CHARACTERIZATIONS - JERSEY STITCH

| Fabric No. | Finished Fabric Weight oz/yd² | Weight gm/100cm² | Width in. | Width m. | Count(W × C) in.⁻¹ | Count cm.⁻¹ | Bulk cc/gm | Greige Fabric Weight oz/yd² | Weight gm/100cm² | Bulk cc/gm. |
|---|---|---|---|---|---|---|---|---|---|---|
| III-C | 2.2 | .747 | 66.75 | 1.695 | 39× 63 | 15.4 × 24.8 | 5.90 | 2.3 | .781 | 6.46 |
| III-D | 2.24 | .760 | 54.75 | 1.391 | 48 × 56 | 18.9 ×22.0 | 4.55 | 2.00 | .679 | 4.90 |
| III-E | 2.2 | .747 | 67 | 1.702 | 39 × 62 | 15.4 × 24.4 | 5.22 | 2.2 | .747 | 5.68 |
| III-F | 2.1 | .713 | 67.25 | 1.708 | 38 × 67 | 15.0 × 26.4 | 4.20 | 2.2 | .747 | 5.02 |
| III-G | 2.0 | .679 | 67.75 | 1.721 | 38 × 52 | 15.0 × 20.5 | 5.64 | 1.9 | .645 | 7.01 |
| III-H No. | 2.3 | .781 | 67.75 | 1.721 | 39 × 68 | 15.4 × 26.8 | 5.03 | 2.5 | .848 | 6.48 |
| III-I | — | — | — | — | — | — | — | — | — | — |
| III-J | 3.21 | 1.089 | 54.75 | 1.391 | 49 × 69 | 19.3 × 27.2 | 6.39 | 2.7 | .916 | 6.48 |

EXAMPLE IV

This example illustrates that the partially double ended warp knitted process is also capable of creating longitudinal wale-grouped patterns when more complicated knitting stitches are employed. Except for the different stitch employed, this example duplicates the knitting arrangement of the previous examples, every seventh end being doubled at the front bar. The front bar stitch is 1-0,1-0, 2-3,1-0 and the back bar stitch is the 1-0,0-1 open chain. Yarn A is used throughout, and R = 0.88.

Top runner length = 53.5 in (1.359 m)
Middle runner length = 47 in (1.194 m)
Back runner length = 30.25 in (0.768 m)
Quality = 6 in (15.2 cm)
Greige weight = 1.0 oz/yd² (0.679 gm/100 cm²)
Greige bulk = 6.53 cc/gm
Finished weight = 2.3 oz/yd² (0.781 gm/100 cm²)
Finished width = 78.5 in (1.994 m)
Finished count = 34×88 in⁻¹ (1.34×34.6 cm⁻¹)
Finished bulk = 5.71 cc/gm The muted but clear pattern obtained consists of close 3-wale groupings alternating with groups of four uniformly spaced wales.

EXAMPLE V

Figures 1A, 1B, 1C, 1D, 1E, 1F, 1G, 1H, 1I, 1J:
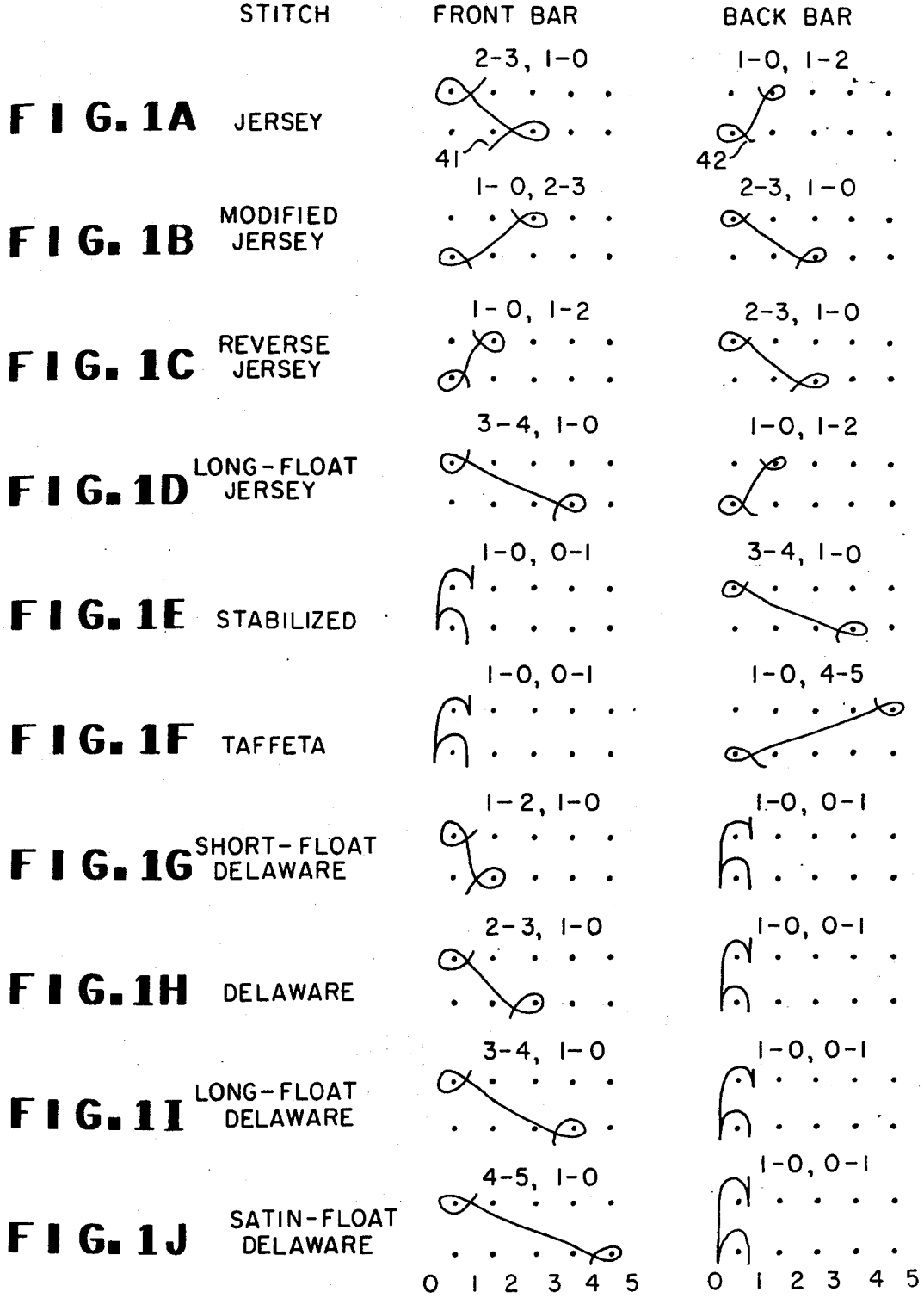
FIGS. 1A to 1J are stitch pattern diagrams for different types of basic warp-knitting with the front and back bars of each stitch construction shown separately.

This example illustrates patterning effects obtained when yarns from a partial middle beam are threaded through spaced positions of both front and back fully threaded guide bars for knitting together with the normally threaded yarns already in these spaced positions. Two fabrics (Fabric V-A and Fabric V-B) were prepared using the Jersey stitch (FIG. 1A). The front (or top) and back beams were fully threaded with 10-filament 30-denier (33.3 dtex) polyhexamethylene adipamide yarns, and the middle beam was partial with monofilament gear-crimped 30-denier (33.3 dtex) polyhexamethylene adipamide yarn (1 in, 6 out). The monofilament yarn was crimped as taught in U.S. Pat. No. 3,833,976 using gears described in connection with FIGS. 6, 7, and 8 thereof. Both fabrics were knit at identical machine settings, i.e.:

Front bar runner = 55 in (1.397 m)
Middle bar runner = 43.5 in (1.105 m)
Back bar runner = 42 in (1.067 m)
Quality = 7 in (2.76 cm)

The threading for Fabric V-A was repeated across the whole fabric width in units of 14 adjacent needle positions. In each position 1 a middle-beam end was doubled with a front-beam end at the front guide bar and knitted together with it; and at each position 8 a middle-beam end was doubled with a back-beam end at the back-guide bar and knitted together with it. Threading for Fabric V-B was the same except that both middle-beam ends per 14-position repeat were threaded together with normally threaded yarns only at position 1, one in the front and the other in the back guide bar.

Both greige fabrics were about 63 in (1.60 m) wide at a weight of about 2.4 oz/yd² (0.85 gm/100 cm²). The count (WxC) for V-A was 41 × 64 per in (16.1 × 25.2 per cm), and for V-B was 42 × 64 per in (16.5 × 25.2 per cm). For Fabric V-A the finished properties were: 2.7 oz/yd² (0.92 gm/100 cm²) weight and 50 × 61 per in (19.7 × 24.0 per cm) count. For Fabric V-B the finished properties were: 2.8 oz/yd² (0.95 gm/100 cm²) weight and 48 × 62 per in (18.9 × 24.4 per cm) count.

Patterning effects described below were as observed on 15x photographic magnifications of the loop face of each fabric. To the unaided eye, however, the patterning was readily apparent a longitudinal continuous stripes, one for each position modified by inclusion of a middle-beam end. Moreover, each stripe could be sensed by rubbing a finger over the surface.

Corresponding to each position 1 of Fabric V-A was a stripe composed of a raised central wale of larger than normal loops set off on either side by slightly wider than normal interwale spacings. At each position 8, two adjacent wales had distorted stitches, a wider then normal interwale spacing, and were rotated about each wale axis such that a single protruding ridge developed.

Corresponding to each position 1 of fabric V-B was a stripe of three adjacent wales very tightly joined side-by-side and each with larger than normal stitches. The three-wale stripe also protruded from the fabric surface and occupied only about 80% as much fabric width as was occupied by three adjacent wales in unaffected fabric area.

What is claimed is:

1. In a method for producing warp knitted fabrics on a warp knitting machine having two full sets of warp threads, including the steps of feeding one of said two full sets of threads to each position of one of two operating guide bars and then to each needle of said warp knitting machine and feeding the other of said two full sets to each position of the other operating guide bar and to each needle of said warp knitting machine to form a knitted fabric, the improvement comprising: feeding a partial beam set of threads to spaced positions of at least one of said guide bars and then to spaced needle for knitting together with one of said full sets of threads, whereby spaced double threads are knitted as a combined single thread, said partial beam set of threads being fed with respect to said one of said full set of threads to provide a ratio R of less than about 1.3.

2. Th method of claim 1, one of the two operating guide bars being the front guide bar of the warp knitting machine, said partial beam set of threads being fed to said front guide bar.

3. The method of claim 2, threads from said partial beam set of threads being fed to every fourth needle.

4. The method of claim 2, threads from said partial beam set of threads being fed to every fifth needle.

5. The method of claim 2, threads from said partial beam set of threads being fed to every sixth needle.

6. The method of claim 2, threads from said partial beam set of threads being fed to every seventh needle.

7. The method of claim 2, threads from said partial beam set of threads being fed to every eighth needle.

8. The method of claim 2, threads from said partial beam set of threads being fed to every ninth needle.

9. The method of claim 2, the partial beam set of threads being fed with respect to said one of said full beam set of threads to provide a ratio R of runner lengths of the partial beam set of threads to the full beam set of threads in the range of from about 0.5 to about 1.3.

10. The method of claim 1, said partial beam set of threads being fed to both of said guide bars in a spaced repeating pattern.

11. The method of claim 1, one of the two operating guide bars being the front guide bar the other being the back guide bar, said partial beam set of threads being fed alternately to the front and back guide bars in a spaced repeating pattern.

12. The method of claim 11, said partial beam set of threads being fed alternately to the front and back guide bars every seventh needle.

13. The method of claim 10, said partial beam set of threads being fed to the same needle position.

* * * * *

UNITED STATES PATENT OFFICE
CERTIFICATE OF CORRECTION

PATENT NO. : 4,020,656

DATED : May 3, 1977

INVENTOR(S) : Bharat Jaybhadra Gajjar

It is certified that error appears in the above-identified patent and that said Letters Patent are hereby corrected as shown below:

Col. 2, line 1, Change "Fig. 1" to -- Fig. 2 --

Col. 3, line 43, Change "(Figs. 1G to 1I)" to -- (Figs. 1G to 1J)--

Col. 3, line 53, Change "indicating" to -- including --

Col. 4, line 51, Change "back" to -- beck --

Col. 5, line 49, Change "No." to -- # --

Col. 11, line 35, Change "1.34" to -- 13.4 --

Col. 12, line 32, Change "a" to -- as --

Col. 12, line 63, Change "needle" to -- needles --

Col. 13, line 1, Change "Th" to -- The --

Table 1, Col. 1, Change "I-F" to -- I-F# -- and delete "No." on following line Table 2, Col. 1, Change "I-F" to -- I-F# -- and delete "No." on following line Table 3, Col. 1, Change "II-A" to -- II-A# -- and delete "No." on following line Table 4, Col. 1, Change "II-A" to -- II-A# -- and delete "No." on following line Table 5, Col. 1, Change "III-H" to -- III-H# -- and delete "No." on following line

UNITED STATES PATENT OFFICE

CERTIFICATE OF CORRECTION

PATENT NO. : 4,020,656

DATED : May 3, 1977

INVENTOR(S) : Bharat Jaybhadra Gajjar

It is certified that error appears in the above-identified patent and that said Letters Patent are hereby corrected as shown below:

Table 6, Col. 1, Change "III-H" to -- III-H# -- and delete "No." on following line Table 6, Col. 6, Change "40 x 0 59" to -- 40 x 59 --

Table 6, Col. 9, Change "2.00" to -- 2.0 --

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*